US006574840B1

(12) United States Patent
Doppel

(10) Patent No.: US 6,574,840 B1
(45) Date of Patent: Jun. 10, 2003

(54) PET BURIAL KIT

(76) Inventor: Rosemary C. Doppel, 4760 Widgeon Way, Cumming, GA (US) 30040

( * ) Notice: Subject to any disclaimer, the term of this patent is extended or adjusted under 35 U.S.C. 154(b) by 0 days.

(21) Appl. No.: 10/034,857

(22) Filed: Jan. 3, 2002

(51) Int. Cl.[7] ..... A61G 17/00
(52) U.S. Cl. ..... 27/2; 27/19
(58) Field of Search ..... 27/1, 2, 19, 35

(56) References Cited

U.S. PATENT DOCUMENTS

| | | | | | |
|---|---|---|---|---|---|
| 2,788,530 | A | * | 4/1957 | Ferguson | 5/628 |
| 3,246,379 | A | * | 4/1966 | Slaughter et al. | 27/19 |
| 3,554,687 | A | * | 1/1971 | Cassidy | 422/294 |
| D222,251 | S | * | 10/1971 | Carson | D99/1 |
| 3,997,948 | A | | 12/1976 | Hicks et al. | |
| 4,539,935 | A | * | 9/1985 | Meyer | 119/28.5 |
| D292,635 | S | * | 11/1987 | McCormack et al. | D99/1 |
| 4,790,051 | A | * | 12/1988 | Knight | 27/28 |
| D341,915 | S | * | 11/1993 | Martin | D99/1 |
| 5,282,439 | A | * | 2/1994 | Oaks | 119/482 |
| 5,341,548 | A | | 8/1994 | Zerick | |
| D418,657 | S | | 1/2000 | Lamolinara et al. | |
| 6,052,877 | A | | 4/2000 | Richard | |

FOREIGN PATENT DOCUMENTS

| | | | |
|---|---|---|---|
| JP | 08107914 | A | * 10/1994 |
| JP | 407289110 | A | * 11/1995 |
| JP | 411155916 | A | * 6/1999 |

* cited by examiner

*Primary Examiner*—William L. Miller
(74) *Attorney, Agent, or Firm*—William B. Noll

(57) ABSTRACT

A kit of components for providing a final resting place for a deceased pet. The kit comprises a moisture sealed, burial receptacle for receiving a burial basket containing a blanket, and a plastic bag sized to receive the deceased pet positioned within the burial basket, wherein the plastic bag can be tied to effect closure of the plastic.

10 Claims, 2 Drawing Sheets

PET BURIAL KIT

FIELD OF THE INVENTION

This invention is directed to the field of pet burial assemblies, more particularly to a kit of components to allow pet owners to provide a suitable resting place for a favored pet, such as a cat or dog.

BACKGROUND OF THE INVENTION

The present invention relates to a kit of components to form a peaceful resting place and atmosphere for a deceased pet, whether deceased through natural causes or through an act of euthanasia. Further, the assembled components are made of biodegradable and flammable materials should the pet owner desire to either bury or cremate the pet.

It is difficult to imagine anyone in America's society that has not experienced growing up, or in later life, the joy of having a household pet, such as a dog or cat. In fact, multiple pet families are quite common. Senior citizens, in particular, have turned to pet ownership as a means to ensure continued companionship by a living creature that requires little material means but offers unlimited love and devotion to its owner. As a consequence, pet owners become emotionally attached to their pets. It is also well known that the loss of a pet can be a traumatic experience for its owners. At least one factor adding to the traumatization of the pet owner is the handling of the animal after it has been euthanized or has otherwise deceased. Many pet owners often desire to take their deceased animal to a pet cemetery for burial or crematorium for cremation. If a pet deceases at home, a pet owner may desire to transport the animal to a veterinarian. In either case, it is often necessary to transport the animal after it has died.

It is well known that, after an animal has died, the body fluids begin leaking from the animal. Therefore, in order to transport a dead animal, the animal must first be placed into a receptacle to contain the fluids. Prior to the present invention, deceased animals have been placed in boxes, garbage bags, or the like for transporting and disposing the animals. However, it is not desirable for some to place their animal in such a receptacle because it is not aesthetically pleasing.

The prior art disclose various types of pet receptacles for receiving the deceased pet for burial or creamation. Such prior art is reflected in the following U.S. patents:

a.) U.S. Pat. No. 6,052,877, to Richard, discloses a container for burial of a deceased pet. The pet burial container comprises a fabric bag and a flat sheet. The fabric bag comprises a base arranged to accept the flat sheet therein and a flaccid top portion opposite the base. The deceased pet is placed into the fabric bag such that the deceased pet rests on the flat sheet while the flaccid top portion drapes over the deceased pet, thereby enclosing the deceased pet in the fabric material.

b.) U.S. Pat. No. 5,341,548, to Zerick, teaches a burial/cremation case for animals for receiving a deceased animal for transporting and burying or cremating the same. The burial/cremation case includes a shell member constructed from a liquid-permeable inner layer, an absorbent intermediate layer and an outer layer. The intermediate layer is selectively secured to the outer layer. The outer layer and inner layer are selectively secured one to the other about their perimeters. The inner layer and outer layer may be folded over and secured to define a volume within which the deceased animal may be received. The intermediate layer includes a fluid impervious barrier to prevent fluids from seeping through the outer layer to the outside of the burial/cremation case.

c.) U.S. Pat. No. 3,997,948, to Hicks et al., relates to a modular pet casket comprising one or more modular units which can be locked into position to provide a predetermined longitudinally extended casket for enclosing small, medium or large deceased pets.

The above prior art offers a number of solutions to providing a comfortable final resting place for a deceased family pet, but such solutions are more costly and complex than will be found in the pet burial components of the present invention. The manner by which the present invention meets the challenges of a less costly and complex pet burial system will become clearer in the description which follows.

SUMMARY OF THE INVENTION

This invention is directed to a kit of components for providing an aesthetically pleasing final resting place for a deceased pet. The components are fabricated of biodegradable and flammable materials to give the pet owner the option of a traditional burial or creamation. The kit comprises the following:

a.) a moisture sealed burial receptacle, preferably rectangular in configuration, having a cavity and a hinged cover member, b.) a burial basket of a size to seat within said cavity, c.) a blanket for attaching to said burial basket, and d.) a clear plastic bag including closure means, where the plastic bag is sized to receive the burial basket, blanket and deceased pet for placement in said burial receptacle.

The burial receptacle and burial basket may be provided with hand gripping openings to facilitate carrying of the deceased pet to its final resting location.

Accordingly, an object of this invention is to provide an aesthetically pleasing resting place for a deceased pet.

Another object hereof is a light weight kit of components to allow an owner of a deceased pet to give the pet a well deserved final resting place.

A further object of the invention is the provision of a kit of components to form a suitable burial place for a deceased pet, where the components thereof are formed of biodegradable and flammable materials to allow the pet owner to choose conventional burial or creamation.

These and other objects of the invention will become more apparent in the specification which follows, especially when read in conjunction with the accompanying drawings.

DETAILED DESCRIPTION OF PREFERRED EMBODIMENT

Figure 1:
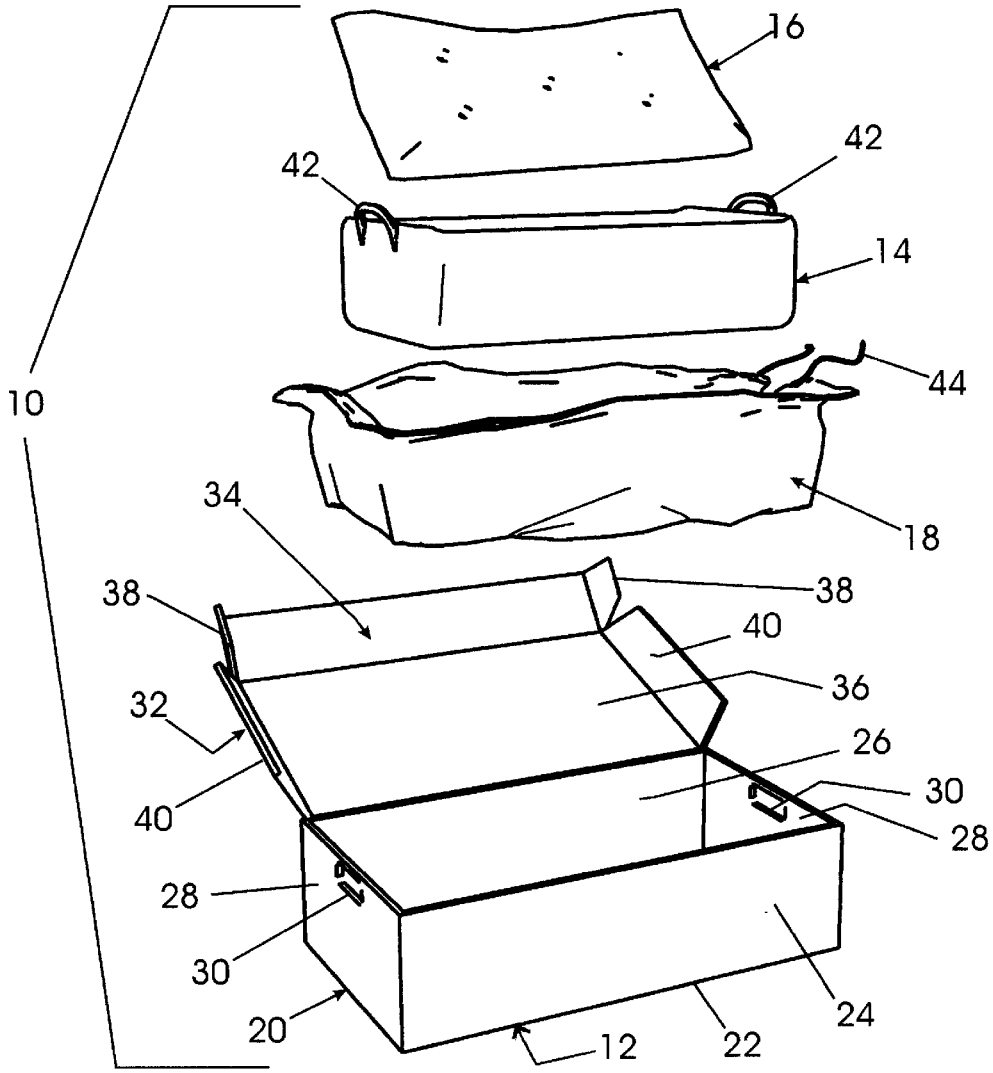
FIG. 1 is an exploded perspective view of a pet burial kit according to the present invention.

The present invention is directed to a kit of components for providing an aesthetically pleasing resting place for a deceased pet, such as household pets like cats and dogs. The kit of components allows the pet owner to privately prepare a pleasant resting place for his/her pet, whether the final resting place is to be a conventional burial or by cremation. The invention will now be described with regard to the two Figures, where like reference numerals repesent like components or features in the two views.

Figure 2:
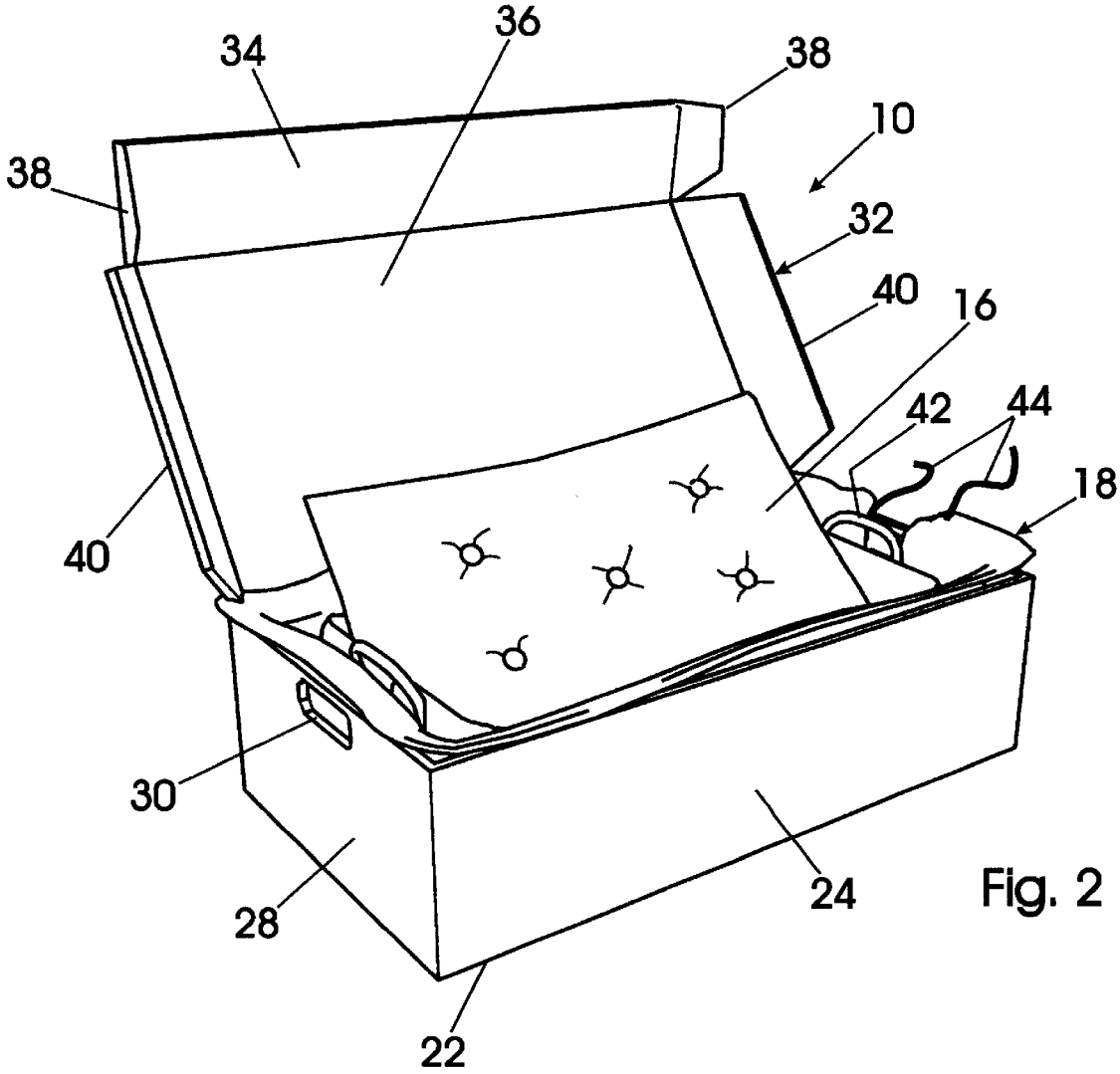
FIG. 2 is a perspective view of the pet burial kit of FIG. 1 showing the assembly prepared for the reception of a deceased pet.

Turning now to FIGS. 1 and 2, where FIG. 1 illustrates the components of the kit 10 in an exploded fashion, and FIG. 2 shows the assembled components, the kit 10 comprises a burial receptacle 12, a burial basket 14, a blanket or pillow 16 and a clear plastic bag 18. The burial receptacle 12 comprises a generally receptacle box 20, such as formed of a biodegradable and flammable material, i.e. heavy weight or double weight cardboard. The receptacle box 20 includes a base 22, front and rear walls 24, 26, respectively, and a pair of side wall 28, where said side walls include opposed openings 30 that function as hand gripping means to easily transport the assembled kit 10. Hinged along the rear wall 26 is a cover member 32, preferably formed of two hinged sections 34 and 36, where each said section includes laterally extending tabs 38 and 40, respectively. In the closed and transporting mode for the assembled kit, the respective tabs 38, 40 and first section 34 are received within the side and front walls. To avoid problems and any associated discomfort, such as fluid leaks, for the pet owner, the burial receptacle may be coated with a moisture resistant coating.

The burial basket 14 may be a light weight, pleasantly appearing wicker material, with a pair of handles 42. The burial basket 14 is sized to readily seat within the burial receptacle 12. For placement within the burial basket is a pillow or blanket 16 that may include a fastening mechanism, such as an adhesive, i.e. glue, or a hook and pile type fastening strips, known commercially as VELCRO, a trademark.

A final component is a clear plastic bag 18 that features a draw string 44 to effect closure of the bag. The bag is sized to receive the burial basket and blanket, or pillow, containing the deceased pet, and placed in the burial receptacle 12. By the use of a clear plastic bag the pet owner may privately visit with and say his/her goodbyes to the deceased pet. Thereafter, the cover member may be closed with the various tabs tucked into the burial receptacle, but not before placing any favorite toys or items in the receptacle. With the assembled and filled kit, the selected manner of disposing of the pet may be followed.

It is recognized that changes, variations, and modifications may be made to the kit of components of the invention without departing from the spirit and scope thereof. Accordingly, no limitation is intended to be imposed thereon except as set forth in the accompanying claims.

What is claimed is:

1. A kit of components for providing an aesthetically pleasing final resting place for a deceased pet, said kit comprising a burial receptacle fabricated from a flammable and biodegradable material, where said receptacle includes a receptacle portion having a hinged cover member to effect closure thereof, a burial basket of a size to be seated within said receptacle portion, a blanket sized to fit within said burial basket, and a clear plastic bag having means to effect closure of said plastic bag, where said bag is sized to receive said blanket containing burial basket.

2. The pet burial kit of components according to claim 1, wherein said receptacle portion includes a pair of side walls, each having a hand gripping opening therein, and said burial basket including hand gripping handles aligned with a respective said hand gripping opening.

3. The pet burial kit of components according to claim 2, wherein said hinged cover member comprises a pair of hingedly joined sections, where a first said section is inserted into said receptacle portion.

4. The pet burial kit of components according to claim 3, wherein said first section includes a pair of laterally extending tabs hinged thereto for receipt into said receptacle portion in the closed position.

5. The pet burial kit of components according to claim 3, wherein a second section of said hingedly joined sections includes a pair of laterally extending tabs operable to be received within said receptacle portion in the closed position.

6. The pet burial kit of components according to claim 1, wherein said burial receptacle is moisture sealed.

7. The pet burial kit of components according to claim 1, wherein said means to effect closure of said plastic bag comprises a constricting cord member having free ends to be tied tightly together.

8. The pet burial kit of components according to claim 1, including fastening means to secure said blanket within said burial basket.

9. The pet burial kit of components according to claim 8, wherein said fastening means includes complementary hook and pile strips.

10. The pet burial kit of components according to claim 8, wherein said fastening means includes an adhesive.

* * * * *